US011052670B2

(12) United States Patent
Mori

(10) Patent No.: US 11,052,670 B2
(45) Date of Patent: Jul. 6, 2021

(54) LIQUID CIRCULATION DEVICE AND LIQUID DISCHARGE APPARATUS INCLUDING THE LIQUID CIRCULATION DEVICE

(71) Applicant: Atsushi Mori, Tokyo (JP)

(72) Inventor: Atsushi Mori, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/677,432

(22) Filed: Nov. 7, 2019

(65) Prior Publication Data

US 2020/0147977 A1 May 14, 2020

(30) Foreign Application Priority Data

Nov. 13, 2018 (JP) ..... JP2018-212893

(51) Int. Cl.
*B41J 2/18* (2006.01)
*B41J 2/175* (2006.01)
*B41J 2/185* (2006.01)

(52) U.S. Cl.
CPC ..... *B41J 2/18* (2013.01); *B41J 2/175* (2013.01); *B41J 2/17596* (2013.01); *B41J 2/185* (2013.01)

(58) Field of Classification Search
CPC ..... B41J 2/18
See application file for complete search history.

(56) References Cited

U.S. PATENT DOCUMENTS 6,155,663 A * 12/2000 Takayanagi ..... B41J 2/04551 347/40
6,164,850 A * 12/2000 Speakman ..... B29C 64/112 400/120.09
6,371,608 B1 * 4/2002 Kato ..... B41J 2/2114 347/96
2008/0273885 A1 11/2008 Koizumi et al.
2009/0091779 A1 * 4/2009 Ishinaga ..... B41J 3/543 358/1.15
2010/0079514 A1 4/2010 Shibata
2012/0044284 A1 2/2012 Katoh
2014/0098152 A1 4/2014 Mishima
(Continued)

FOREIGN PATENT DOCUMENTS

EP 2857202 A1 4/2015
EP 3527382 A1 8/2019
JP 2008-299315 12/2008
(Continued)

OTHER PUBLICATIONS

European Search Report; Application No. EP19207788; dated Mar. 11, 2020.

*Primary Examiner* — Shelby L Fidler
(74) *Attorney, Agent, or Firm* — Duft & Bornsen, PC

(57) ABSTRACT

A liquid circulation device includes a circulation path, a liquid feeding device, and circuitry. The circulation path is configured to circulate a liquid to be supplied to a liquid discharge head of a circulatory type and collected from the liquid discharge head. The liquid feeding device is configured to feed the liquid to circulate the liquid in the circulation path. The circuitry is configured to control an amount of the liquid to be fed by the liquid feeding device, on a basis of discharge information about the liquid to be discharged from the liquid discharge head.

6 Claims, 13 Drawing Sheets

(56) References Cited

U.S. PATENT DOCUMENTS

| | | | | |
|---|---|---|---|---|
| 2015/0110514 | A1 | 4/2015 | Mori et al. | |
| 2019/0299592 | A1 * | 10/2019 | Iwasaki | B41J 2/17596 |

FOREIGN PATENT DOCUMENTS

| | | | | |
|---|---|---|---|---|
| JP | 2014-113816 | | | 6/2014 |
| JP | 2014151528 | A | * | 8/2014 |
| JP | 2015-079147 | | | 4/2015 |
| JP | 2017-065159 | | | 4/2017 |
| JP | 2018030047 | A | | 3/2018 |
| JP | 2018089949 | A | | 6/2018 |
| JP | 2019014194 | A | * | 1/2019 |
| WO | 2018037922 | A1 | | 3/2018 |

* cited by examiner

LIQUID CIRCULATION DEVICE AND LIQUID DISCHARGE APPARATUS INCLUDING THE LIQUID CIRCULATION DEVICE

CROSS-REFERENCE TO RELATED APPLICATION

This patent application is based on and claims priority pursuant to 35 U.S.C. § 119(a) to Japanese Patent Application No. 2018-212893, filed on Nov. 13, 2018, in the Japan Patent Office, the entire disclosure of which is hereby incorporated by reference herein.

BACKGROUND

Technical Field

The present disclosure relates to a liquid circulation device and a liquid discharge apparatus including the liquid circulation device.

Discussion of the Background Art

A liquid discharge head (hereinafter also referred to simply as a "head") may be a flow-through head (a circulatory head) that includes a supply channel leading to individual liquid chambers communicating with nozzles and collection channels communicating with the individual liquid chambers, and has a liquid supply port communicating with the supply channels and a liquid collection port communicating with the collection channels.

SUMMARY

In an aspect of the present disclosure, there is provided a liquid circulation device that includes a circulation path, a liquid feeding device, and circuitry. The circulation path is configured to circulate a liquid to be supplied to a liquid discharge head of a circulatory type and collected from the liquid discharge head. The liquid feeding device is configured to feed the liquid to circulate the liquid in the circulation path. The circuitry is configured to control an amount of the liquid to be fed by the liquid feeding device, on a basis of discharge information about the liquid to be discharged from the liquid discharge head.

In another aspect of the present disclosure, there is provided a liquid discharge apparatus that includes a plurality of liquid discharge heads and the liquid circulation device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
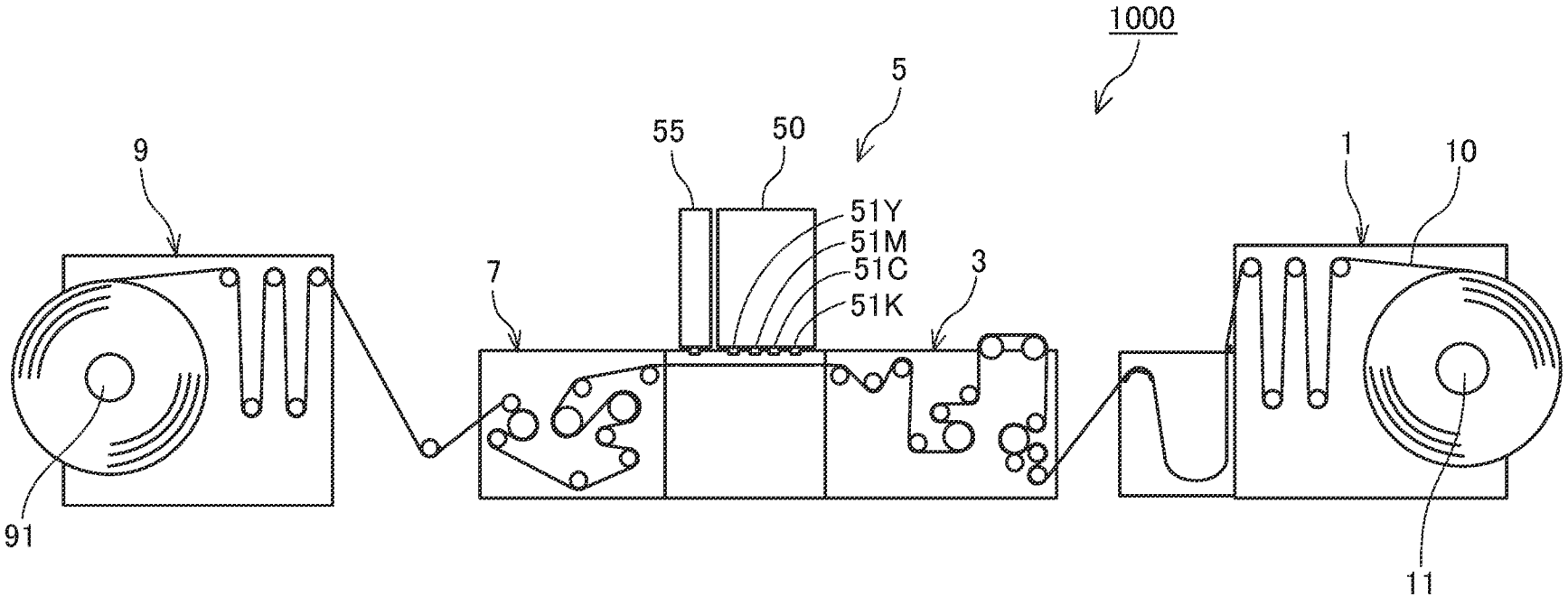
FIG. 1 is a schematic view for explaining an example of a printing apparatus that is a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Figure 2:
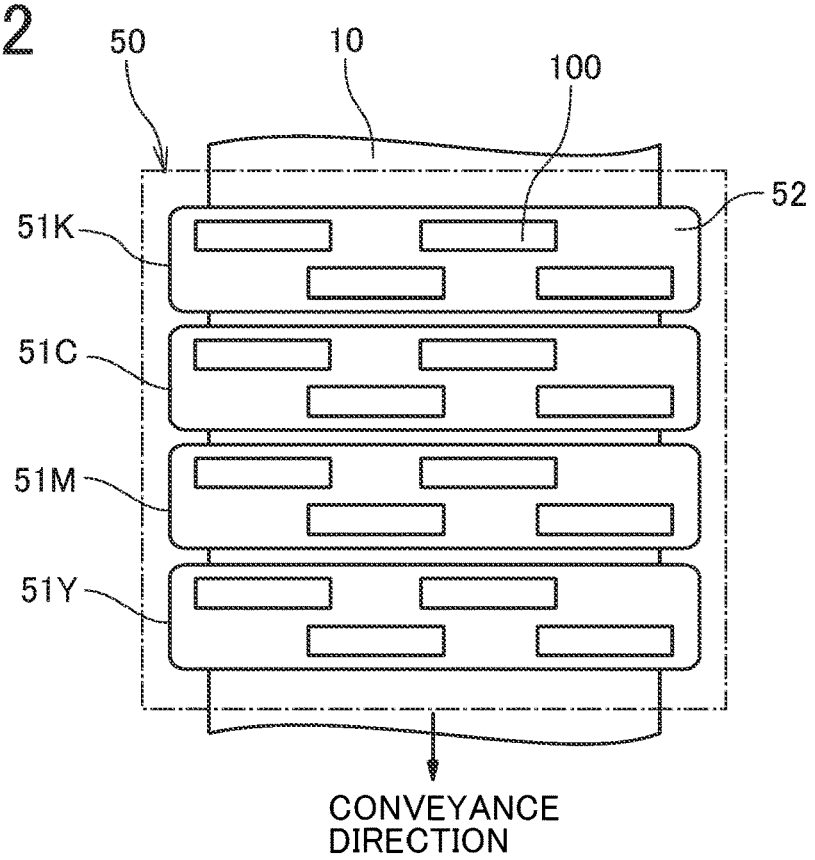
FIG. 2 is a plan view for explaining an example of a head device of the printing apparatus.

The following is a description of embodiments of the present disclosure, with reference to the accompanying drawings. Referring first to FIGS. 1 and 2, an example of a printing apparatus as a liquid discharge apparatus according to an embodiment of the present disclosure is described.

FIG. 1 is a schematic view for explaining the printing apparatus, and FIG. 2 is a plan view for explaining an example of a head device of the printing apparatus.

This printing apparatus 1000 includes: a feeder 1 that imports a continuous medium 10 such as continuous paper; a guide conveyor 3 that guides and conveys the continuous medium 10 imported through the feeder 1 to a printer 5; the printer 5 that performs printing to form an image by discharging liquid onto the continuous medium 10; a drier 7 that dries the continuous medium 10; and a carrier 9 that exports the continuous medium 10.

The continuous medium 10 is sent out from an original winding roller 11 of the feeder 1, is guided and conveyed by the respective rollers of the feeder 1, the guide conveyor 3, the drier 7, and the carrier 9, and is wound up by a wind-up roller 91 of the carrier 9.

In the printer 5, the continuous medium 10 is conveyed while facing a head device 50 and a head device 55. An image is formed with liquid discharged from the head device 50, and post-processing is performed with a treatment liquid discharged from the head device 55.

In the head device 50, full-line head arrays 51K, 51C, 51M, and 51Y for four colors (hereinafter referred to as the "head arrays 51" when the colors are not distinguished from one another) are arranged in this order from the upstream side in the conveying direction, for example.

The respective head arrays 51 are liquid discharging units, and discharge liquids of black K, cyan C, magenta M, and yellow Y, respectively, onto the continuous medium 10 being conveyed. Note that the colors and the numbers of the colors are not limited to this example.

As illustrated in FIG. 2, each head array 51 has liquid discharge heads (also referred to simply as "heads") 100 arranged on a base member 52 in a staggered manner, for example. However, the head arrays 51 do not necessarily have this staggered arrangement.

Figure 3:
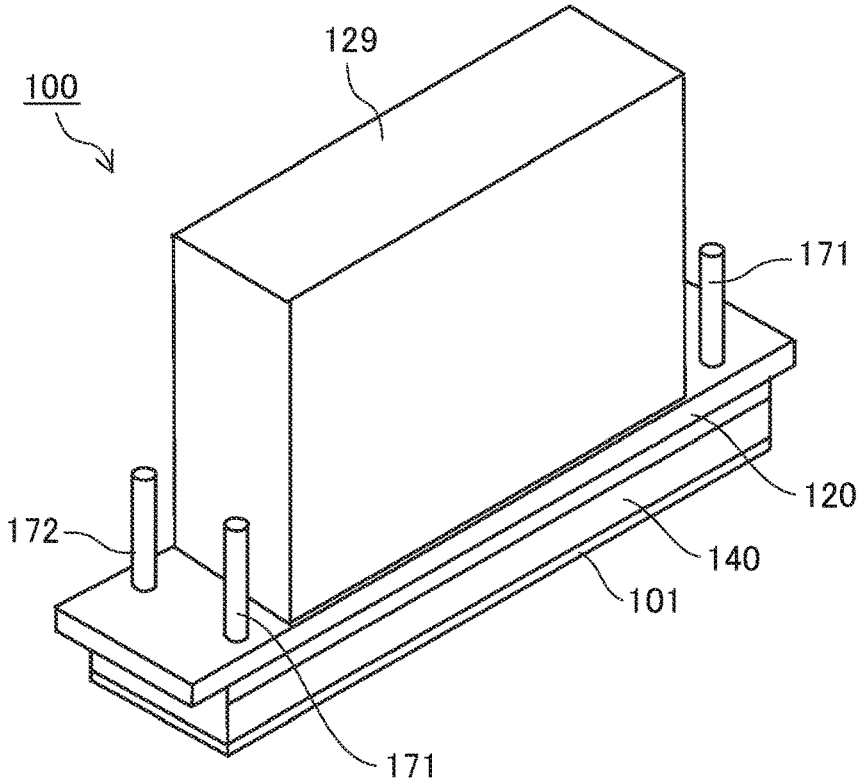
FIG. 3 is an external view for explaining an example of a liquid discharge head.
Figure 4:
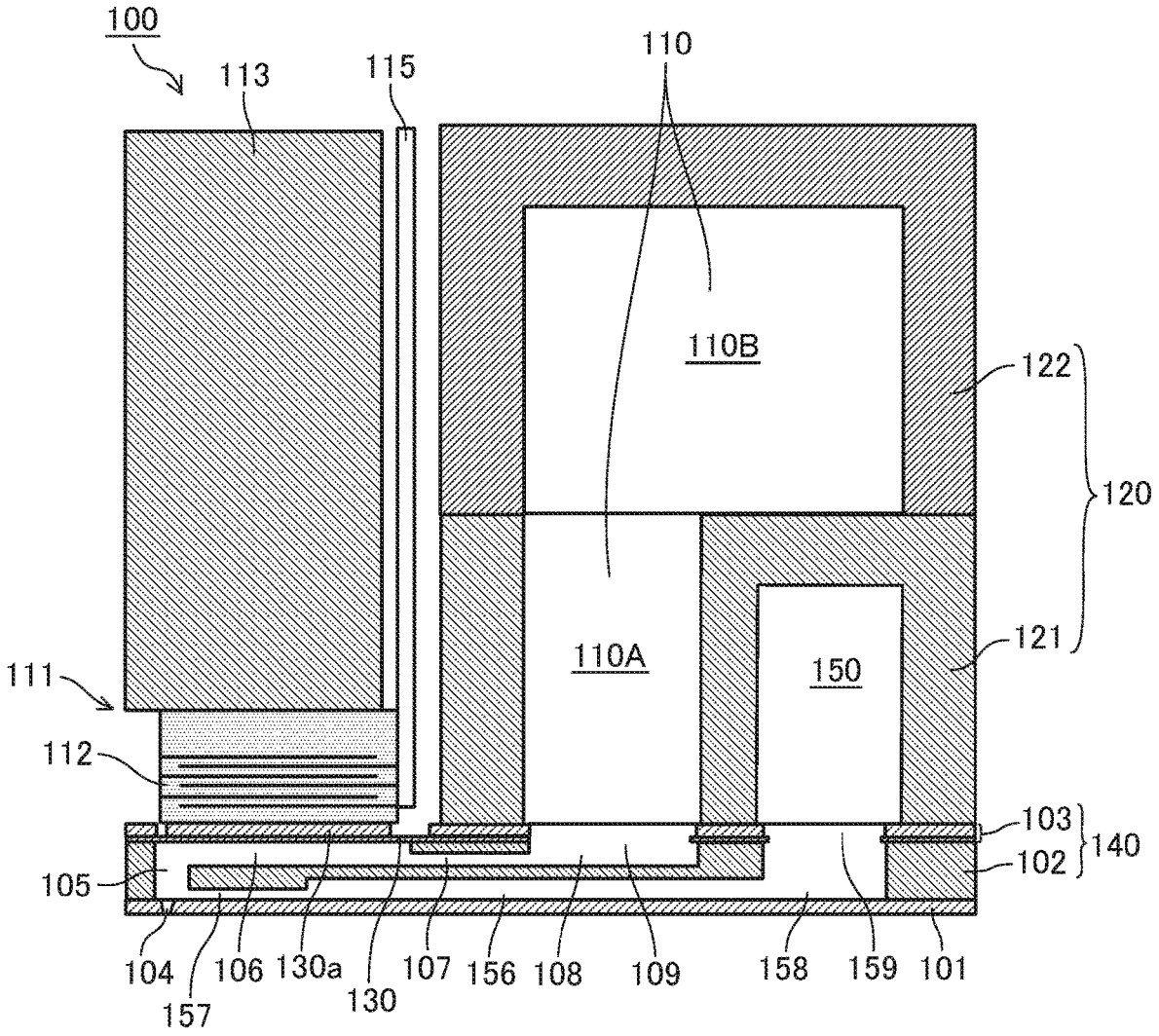
FIG. 4 is a cross-sectional view for explaining the head, taken in a direction (the liquid chamber longitudinal direction) perpendicular to the nozzle array direction.

Referring now to FIGS. 3 and 4, an example of a liquid discharge head is described. FIG. 3 is an external perspective view for explaining the liquid discharge head. FIG. 4 is a cross-sectional view for explaining a direction (the liquid chamber longitudinal direction) orthogonal to the nozzle arrangement direction of the head.

This liquid discharge head 100 is a flow-through head, and a nozzle plate 101, a channel plate 102, and a diaphragm member 103 as a wall surface member are stacked and joined in the liquid discharge head 100. The liquid discharge head 100 also includes a piezoelectric actuator 111 that displaces the vibration region (diaphragm) 130 of the diaphragm member 103, a common channel member 120 that also serves as the frame member of the head, and a cover 129. The portion formed with the channel plate 102 and the diaphragm member 103 is referred to as the channel member 140.

The nozzle plate 101 includes a plurality of nozzles 104 that discharges liquid.

The channel plate 102 forms a pressure chamber (individual liquid chambers) 106 communicating with the nozzles 104 via a nozzle communicating path 105, a supply-side fluid resistance portion 107 communicating with the pressure chamber 106, and a supply-side introduction portion 108 communicating with the supply-side fluid resistance portion 107. The nozzle communicating path 105 is a channel communicating with both the nozzles 104 and the pressure chamber 106. The supply-side introduction portion 108 communicates with a supply-side common channel 110 via a supply-side opening 109 formed in the diaphragm member 103.

The diaphragm member 103 has a deformable vibration region 130 that forms a wall surface of the pressure chamber 106 of the channel plate 102. Here, the diaphragm member 103 has a two-layer structure (but is not limited to a two-layer structure), and is formed with a first layer forming a thin portion and a second layer forming a thick portion in this order from the side of the channel plate 102. The first layer forms the deformable vibration region 130 in the portion corresponding to the pressure chamber 106.

The piezoelectric actuator 111 including an electromechanical transducer serving as a driver unit (an actuator unit, and a pressure generator unit) that deforms the vibration region 130 of the diaphragm member 103 is disposed on the opposite side of the diaphragm member 103 from the pressure chamber 106.

In this piezoelectric actuator 111, a piezoelectric member joined onto a base member 113 is grooved by half-cut dicing, to form a required number of columnar piezoelectric elements 112 at predetermined intervals in a comb-like fashion.

The piezoelectric elements 112 are then joined to a raised portion 130*a* that is an island-like thick portion in the vibration region 130 of the diaphragm member 103. Further, a flexible wiring member 115 is connected to the piezoelectric elements 112.

The common channel member 120 forms the supply-side common channel 110 and a collection-side common channel 150. The supply-side common channel 110 communicates with supply ports 171, and the collection-side common channel 150 communicates with collection ports 172.

Here, the common channel member 120 is formed with a first common channel member 121 and a second common channel member 122. The first common channel member 121 is jointed to the channel member 140 at the side of the diaphragm member 103, and the second common channel member 122 is stacked on and joined to the first common channel member 121.

The first common channel member 121 forms a downstream-side common channel 110A that is a part of the supply-side common channel 110 communicating with the supply-side introduction portion 108, and the collection-side common channel 150 communicating with collection-side individual channels 156. Meanwhile, the second common channel member 122 forms an upstream-side common channel 110B that is the remaining portion of the supply-side common channel 110.

Further, the channel plate 102 forms a collection-side fluid resistance portion 157 communicating with each individual liquid chamber 106 via the nozzle communicating path 105, the collection-side individual channels 156, and a collection-side outlet portion 158.

The collection-side outlet portion 158 communicates with the collection-side common channel 150 via a collection-side opening 159 formed in the diaphragm member 103.

In this embodiment, the supply-side common channel 110, the supply-side opening 109, the supply-side introduction portion 108, and the supply-side fluid resistance portion 107 constitute a supply channel, and the collection-side fluid resistance portion 157, the collection-side individual channels 156, the collection-side outlet portion 158, and the collection-side opening 159 constitute a collection channel.

In this liquid discharge head, the voltage to be applied to the piezoelectric elements 112 is lowered from a reference potential (intermediate potential), for example, so that the piezoelectric elements 112 contract, and the vibration region 130 of the diaphragm member 103 descends, to increase the volume of the pressure chamber 106. As a result, liquid flows into the pressure chamber 106.

After that, the voltage to be applied to the piezoelectric elements 112 is increased to elongate the piezoelectric elements 112 in the stacking direction, and the vibration region 130 of the diaphragm member 103 is deformed in the direction toward the nozzles 104 to reduce the volume of the pressure chamber 106. As a result, the liquid in the pressure chamber 106 is pressurized, and the liquid is discharged from the nozzles 104.

Further, the liquid that is not discharged from the nozzles 104 passes through the nozzles 104, and is recovered into the collection-side common channel 150 from the collection-side fluid resistance portion 157, the collection-side individual channels 156, the collection-side outlet portion 158, and the collection-side opening 159. The liquid is then supplied again to the supply-side common channel 110 from the collection-side common channel 150 through an external circulation path.

Furthermore, even when a liquid discharge operation for discharging the liquid from the nozzles 104 is not being performed, the liquid is recovered into the collection-side common channel 150 from the supply-side common channel 110 through the supply-side opening 109, the supply-side introduction portion 108, the supply-side fluid resistance portion 107, the pressure chamber 106, the collection-side fluid resistance portion 157, the collection-side individual channels 156, the collection-side outlet portion 158, and the collection-side opening 159, and is supplied again to the supply-side common channel 110 from the collection-side common channel 150 through the external circulation path.

The method for driving the head is not limited to the above example (pull-push method), and pulling or pushing can be performed depending on the drive waveform.

Figure 5:
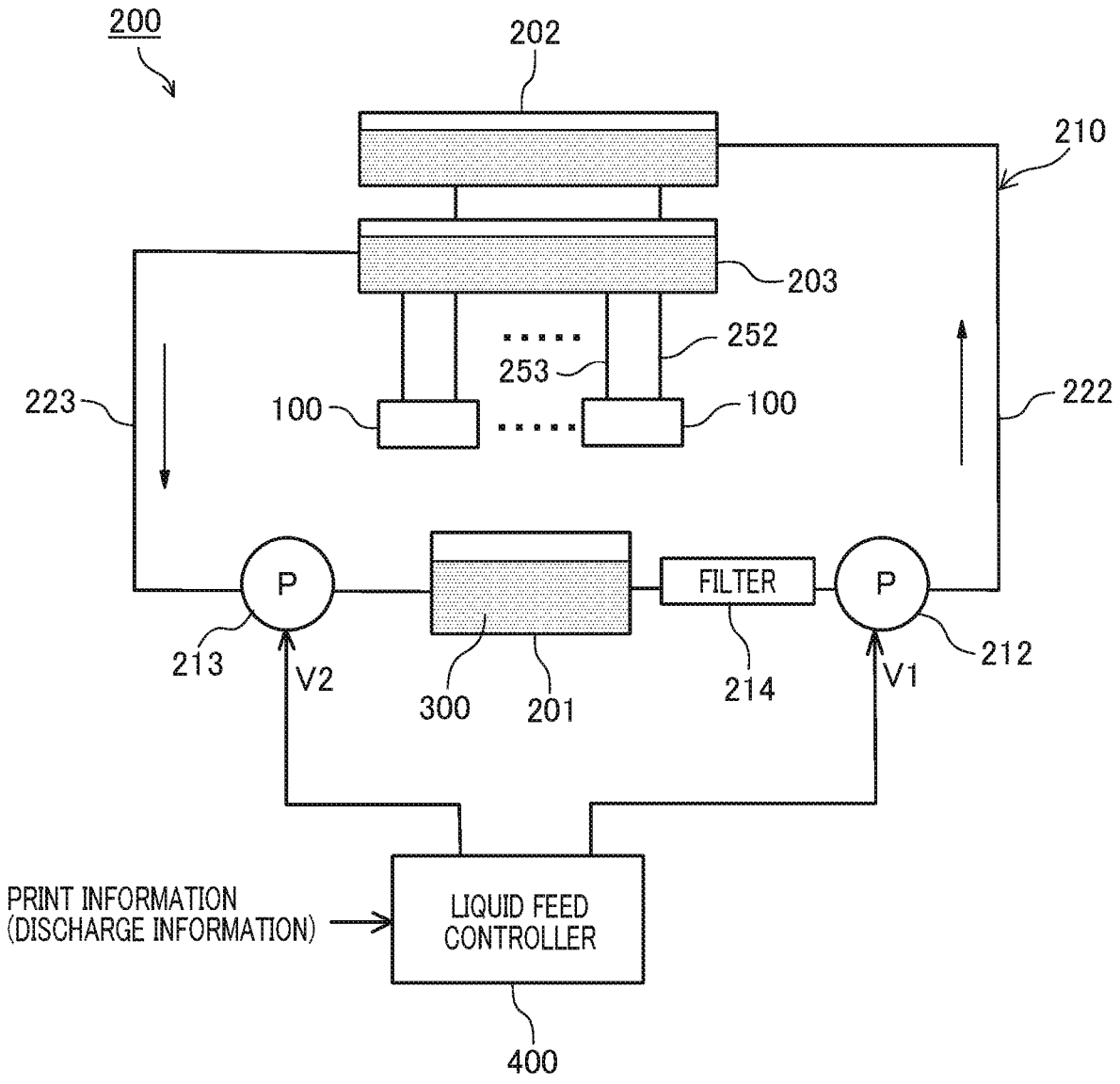
FIG. 5 is a diagram for explaining a liquid circulation device (liquid supply device) according to a first embodiment of the present disclosure.

Referring now to FIG. 5, a first embodiment of the present disclosure is described. FIG. 5 is a diagram for explaining a liquid circulation device (liquid supply device) according to the embodiment.

A liquid circulation device 200 circulates liquid for a plurality of circulatory heads 100 arranged in a line in the width direction of the continuous medium 10.

The liquid circulation device 200 includes a main tank 201 that is a liquid tank serving as a liquid storage storing a liquid 300 discharged from the heads 100. The liquid circulation device 200 also includes a supply tank 202, a collection tank 203, a first liquid feed pump (supply pump) 212 that is a liquid feeding device, a second liquid feed pump (collection pump) 213 that is a liquid feeding device, and a filter 214.

The main tank 201 and the supply tank 202 are connected via a liquid path 222, and the supply pump 212 and the filter 214 are disposed in the liquid path 222. Likewise, the collection tank 203 and the main tank 201 are connected via a liquid path 223, and the collection pump 213 is disposed in the liquid path 223.

The respective supply ports 171 of the plurality of heads 100 are connected to the supply tank 202 via liquid paths 252, and the respective collection ports 172 of the plurality of heads 100 are connected to the collection tank 203 via liquid paths 253.

Here, a circulation path 210 is formed as a path that starts from the main tank 201 and returns to the main tank 201 through the liquid path 222, the supply tank 202, the liquid paths 252, the heads 100, the liquid paths 253, the collection tank 203, and the liquid path 223.

Further, the supply tank 202 and the collection tank 203 are each sealed, containing air inside. Therefore, when the amount of liquid in a tank increases due to an increase in the amount of liquid supplied or a decrease in the amount of liquid collected, the pressure in the tank increases. Conversely, when the amount of liquid in a tank decreases due to a decrease in the amount of liquid supplied or an increase in the amount of liquid collected, the pressure in the tank decreases.

That is, it is possible to change the respective pressures in the supply tank 202 and the collection tank 203 by changing the drive amount of the supply pump 212 or the collection pump 213 and adjusting the liquid feed amount (the supply amount or the collection amount).

The pressure in the supply tank 202 is then made higher than the pressure in the collection tank 203, so that the liquid flows in the heads 100 and circulates in the circulation path 210. That is, the supply pump 212 and the collection pump 213 constitute a unit that causes generation of pressure for circulating the liquid in the circulation path 210.

The supply pump 212 and the collection pump 213, which are liquid feeding devices, are designed to be supplied with power from a power supply device, and change the liquid feed amount with a change in drive amount in accordance with the magnitude of the control voltage to be input. Control voltages V1 and V2 are provided by a liquid feed controller 400.

The liquid feed controller 400 is a unit that controls the amount of liquid feed from the supply pump 212 and the collection pump 213, and is formed with a microcomputer such as a central processing unit (CPU), a read only memory (ROM), a random access memory (RAM), and an input/output (I/O). The liquid feed controller 400 acquires discharge information that is print information input to the printing apparatus 1000 by the user.

The liquid feed controller 400 then determines and outputs the control voltage V1 to the supply pump 212 and the control voltage V2 to the collection pump 213, on the basis of the acquired discharge information.

Figure 6:
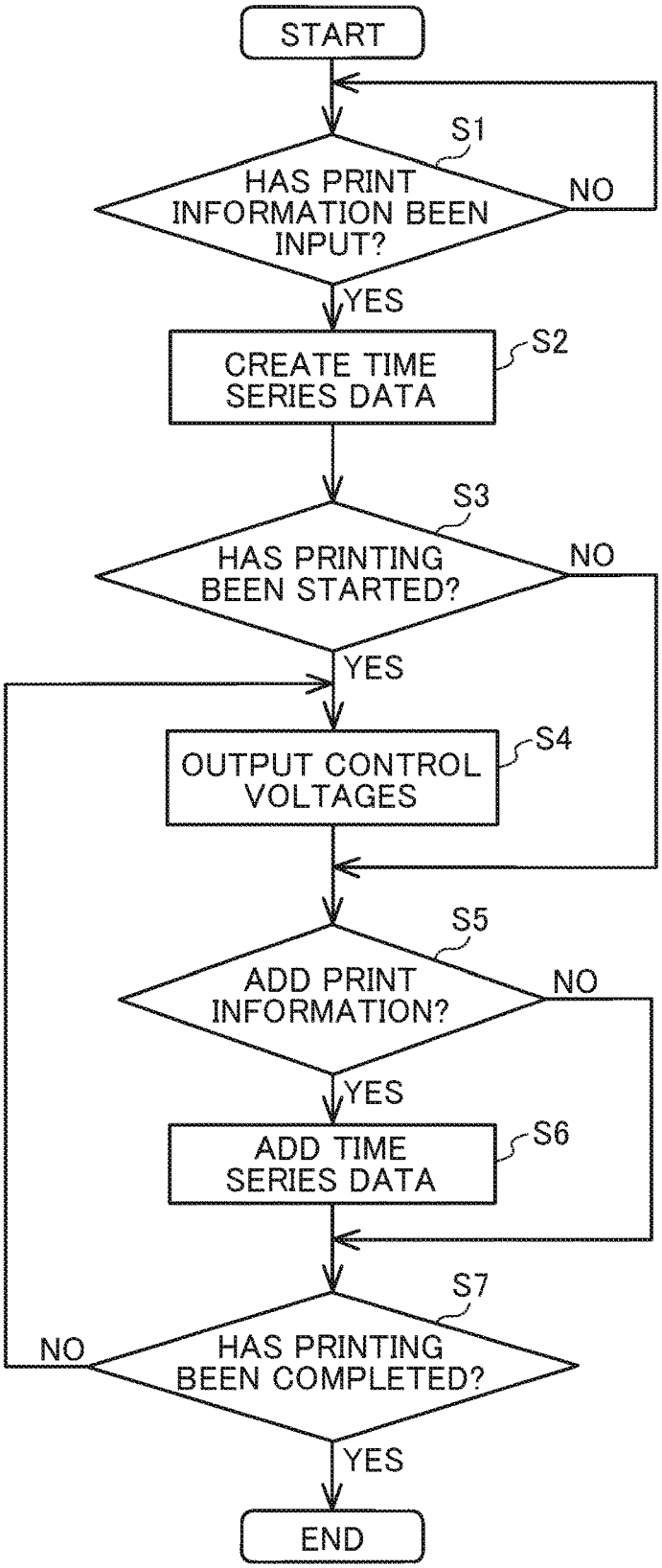
FIG. 6 is a flowchart for explaining liquid feed control to be performed by a liquid feed controller.

Referring now to the flowchart in FIG. 6, liquid feed control to be performed by the liquid feed controller 400 is described.

First, a check is made to determine whether print information has been input (step S1, which will be hereinafter referred to simply as "S1"). If print information has been input, time series data that will be described later is created (S2).

After that, a check is made to determine whether printing has been started (S3). If printing has been started, the control voltages V1 and V2 for controlling the amount of liquid feed are output (S4).

A check is then made to determine whether print information has been added (S5). If print information has already been added at this stage, time series data is added (S6).

A check is then made to determine whether the printing has been completed (S7). The process described so far is repeated until the printing is completed. When the printing is completed, this process is ended.

Figure 7:
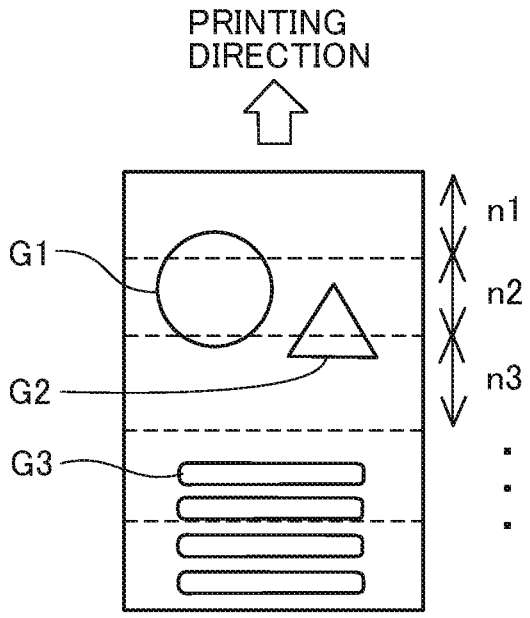
FIG. 7 is a diagram for explaining print information (image information) as discharge information to be supplied to a liquid feed controller, and region division.
Figure 8:
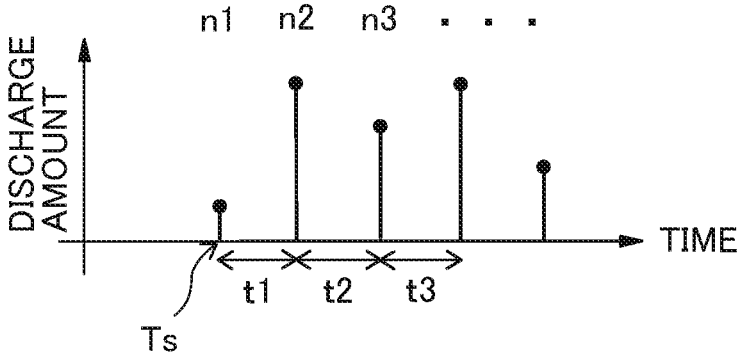
FIG. 8 is a graph for explaining time series data obtained by converting the print information into discharge amounts.

Referring now to FIGS. 7 and 8, discharge information supplied to the liquid feed controller, region division, and the settings of time series data are described. FIG. 7 is a diagram for explaining print information (image information) as the discharge information, and region division. FIG. 8 is a graph for explaining time series data generated by converting the print information into discharge amounts.

As illustrated in FIG. 7, the moving direction of the discharge target (the continuous medium 10 in this embodiment) to which the liquid discharged from the heads 100 is applied is regarded as the printing direction.

Print information (image information) for printing images G1 through G3 is then input to the printing apparatus 1000 by the user, as illustrated in FIG. 7, for example. Supplied with the print information (image information), the liquid feed controller 400 divides the image information into a plurality of predetermined regions nx (x=1, 2, 3, . . . ) such as regions n1, n2, n3, . . . in the printing direction as illustrated in FIG. 7, to convert the image information into discharge amount information for the respective regions nx.

The conversion from the image information into discharge amounts is performed on the basis of "density-discharge amount" information that has been set in advance. In a case where the user performs density adjustment on images, the density information can be added.

From the discharge amounts in the respective regions nx and the printing speed, the discharge amounts in the respective regions nx are set (created) as time series data as illustrated in FIG. 8.

The time tx (x=1, 2, 3, . . . ) of time series data can be calculated as follows.

tx=length of region nx [m]/printing speed [m/s] (x=1, 2, 3, . . . )

The smaller the size of a region nx, the smaller the pressure fluctuation to be expected. However, if each region nx is too small, the computational load on the CPU and the storages constituting the liquid feed controller 400 becomes greater, and calculation at the required speed might be disabled. Therefore, it is preferable to reduce the size of each region as much as possible within such a range that the required calculation speed can be maintained.

Further, the discharge amounts are discharge amounts of liquids that can be handled by the liquid circulation device 200. For example, in the case of an apparatus that prints a full-color image using liquids of the four colors of KCMY, the liquid circulation devices 200 corresponding to the respective colors set time series data, using discharge amounts of the respective colors being handled.

Figure 9A:
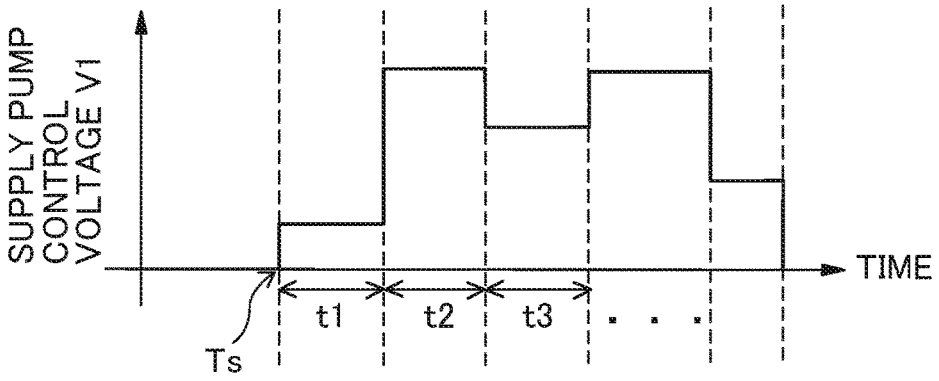
FIGS. 9A and 9B are charts for explaining an example of control voltages to be output from the liquid feed controller in accordance with the time series data.
Figure 9B:
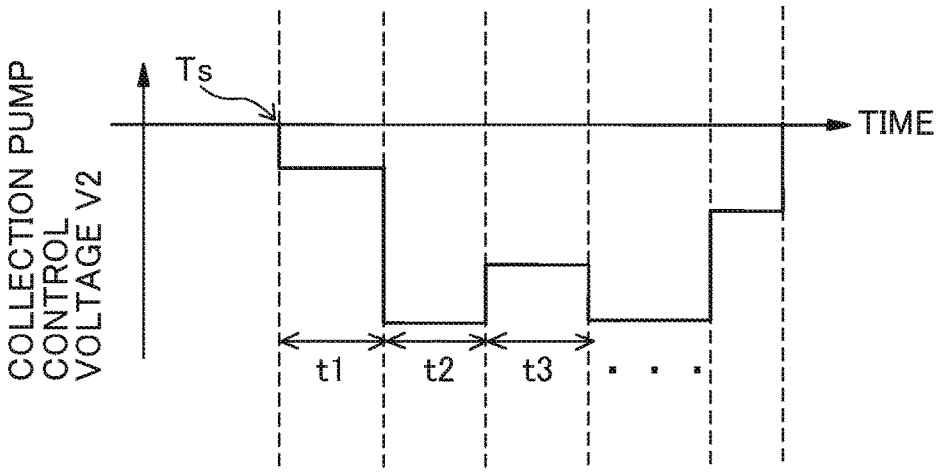

Referring now to FIGS. 9A and 9B, the control voltages to be output from the liquid feed controller are described. FIGS. 9A and 9B are charts for explaining an example of control voltages to be output in accordance with the time series data illustrated in FIG. 8.

As illustrated in FIGS. 9A and 9B, the liquid feed controller 400 determines the respective voltage values (control voltage values) of the control voltage V1 for the supply pump 212 to output in time series and the control voltage V2 for the collection pump 213, on the basis of the calculated time series data (time-series discharge amount information).

The respective voltage values in the supply pump 212 and the collection pump 213 when discharge was continued with a plurality of discharge amounts in experiments were measured in advance, for example, and the amounts of change in the control voltages with respect to discharge amounts may be determined on the basis of information about the measured voltage values. However, since the required control voltage values vary depending on environments such as individual variability among pumps or among liquids and ambient temperature, it is possible to use values obtained by multiplying the pre-calculated values by an appropriate coefficient A. For example, in this embodiment, control voltage values are set, with A being 0.9.

When printing is started, the liquid feed controller 400 changes the control voltages V1 and V2 every time the calculated time tx passes, with the printing start time being a reference time Ts.

Figure 10:
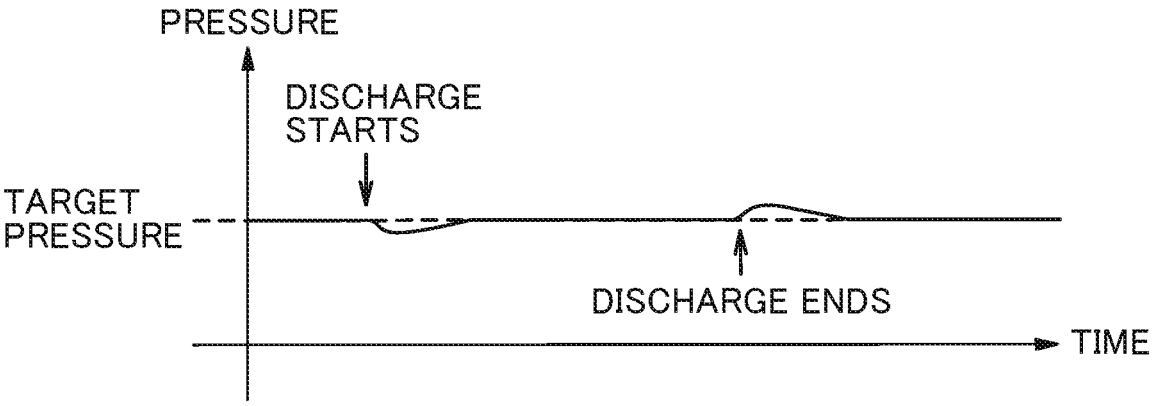
FIG. 10 is a graph for explaining pressure fluctuation in the embodiment.
Figure 11:
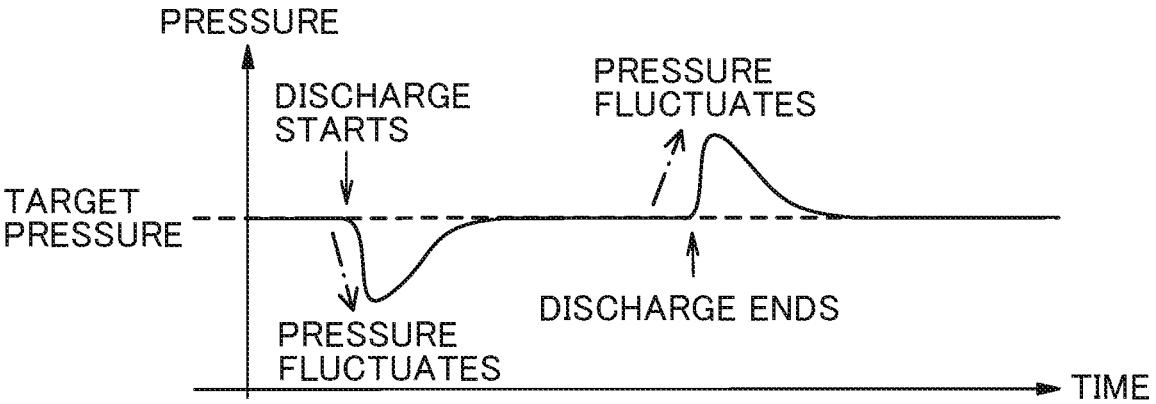
FIG. 11 is a graph for explaining pressure fluctuation in Comparative Example 1.

Referring now to FIGS. 10 and 11, the effects of this embodiment are described. FIG. 10 is a graph for explaining the pressure fluctuation in this embodiment. FIG. 11 is a graph for explaining the pressure fluctuation in Comparative Example 1.

For a liquid to flow from the supply ports 171 of a circulatory head 100 to the collection ports 172, the pressure in the supply tank 202 needs to be higher than the pressure in the collection tank 203. At this stage, it is necessary to keep the pressures at the positions of the nozzles 104 in the head 100 within a predetermined range.

That is, since the nozzles 104 of the head 100 are open to the atmosphere, it is necessary to maintain the pressures at the nozzle positions at values smaller than the atmospheric pressure to prevent dripping from the nozzles 104. On the other hand, if the pressures at the nozzle positions are too much lower than the atmospheric pressure, air will be sucked by the nozzles 104, and bubbles will be generated in the head 100. Therefore, the pressures need to be maintained within a desired range.

Because of this, the desired pressure range within which liquid circulation is achieved is determined by the configuration of the head 100 and the physical properties of the liquid. For example, in this embodiment, it is assumed that the pressure in the supply tank 202 needs to be maintained in the range of −1±1 [kPa], and the pressure in the collection tank 203 needs to be in the range of −8±1 [kPa].

Here, the pressure fluctuation in Comparative Example 1 is described with reference to FIG. 11.

In Comparative Example 1, a pressure sensor is disposed in each of the supply tank 202 and the collection tank 203, a pressure target value is compared with a pressure detection value obtained by the pressure sensor, and at least one of the control voltages for the supply tank 202 and the collection tank 203 is changed in accordance with the difference.

In this configuration of Comparative Example 1, a control voltage can be changed only after pressure fluctuation is detected by a pressure sensor. Therefore, pressure fluctuation immediately after the start of a discharge operation cannot be reduced.

That is, either with a configuration for changing a control voltage by a constant value at a time or with a configuration for changing a control voltage through PID control, a certain period of time is required before a control voltage becomes an appropriate value. Further, a pump also requires a certain time from input of a control voltage till an actual change in the drive amount. In the meantime, the function of controlling pressure does not work, and therefore, the pressure continues to drop because of discharge.

Furthermore, the opposite phenomenon occurs at the end of the discharge operation. That is, to maintain the pressure during the discharge operation, the drive amount of the supply pump 212 is equal to or larger than that in a non-discharge operation, and the drive amount of the collection pump 213 is equal to or smaller than that in a non-discharge operation. If the discharge ends in this state, a pressure rise then occurs. In Comparative Example 1, however, a control voltage is changed after a pressure change occurs. Therefore, immediately after the end of a discharge operation, a large pressure fluctuation occurs on the side with a pressure rise.

As a result, a large pressure fluctuation occurs immediately after the start of a discharge operation and immediately after the end of the discharge operation, as illustrated in FIG. 11. Because of such pressure fluctuations, it becomes difficult to maintain a constant pressure range, depending on device configurations, head configurations, and liquid components. In some cases, a constant pressure range can be maintained, but the discharge amount of from the head varies with pressure fluctuation, for example.

In this embodiment, on the other hand, as described above with reference to FIGS. 7 through 9, the control voltages are changed on the basis of discharge information, to change the liquid feed amount, and reduce pressure fluctuation. Thus, it is possible to prevent rapid pressure fluctuation immediately after the start of a discharge operation and the end of a discharge operation.

That is, the amount of liquid to be discharged from the head 100 is acquired before a discharge operation, and the liquid feeding device (the supply pump 212 and the collection pump 213 in this case) in the circulation path 210 is operated prior to the discharge operation of the head 100.

As a result, the pressure fluctuation in the head 100 immediately after the start or the end of a liquid discharge operation from the head 100 is reduced. Thus, the possibilities of bubble mixing in the head 100 and dripping from the head 100 can be lowered, and stable liquid circulation can be performed so that the amount of liquid to be discharged from the head 100 is stabilized.

Further, as the amount of liquid to be discharged from the head 100 is stabilized, printing quality and fabrication quality to be achieved with the liquid discharge apparatus are improved.

Figure 12:
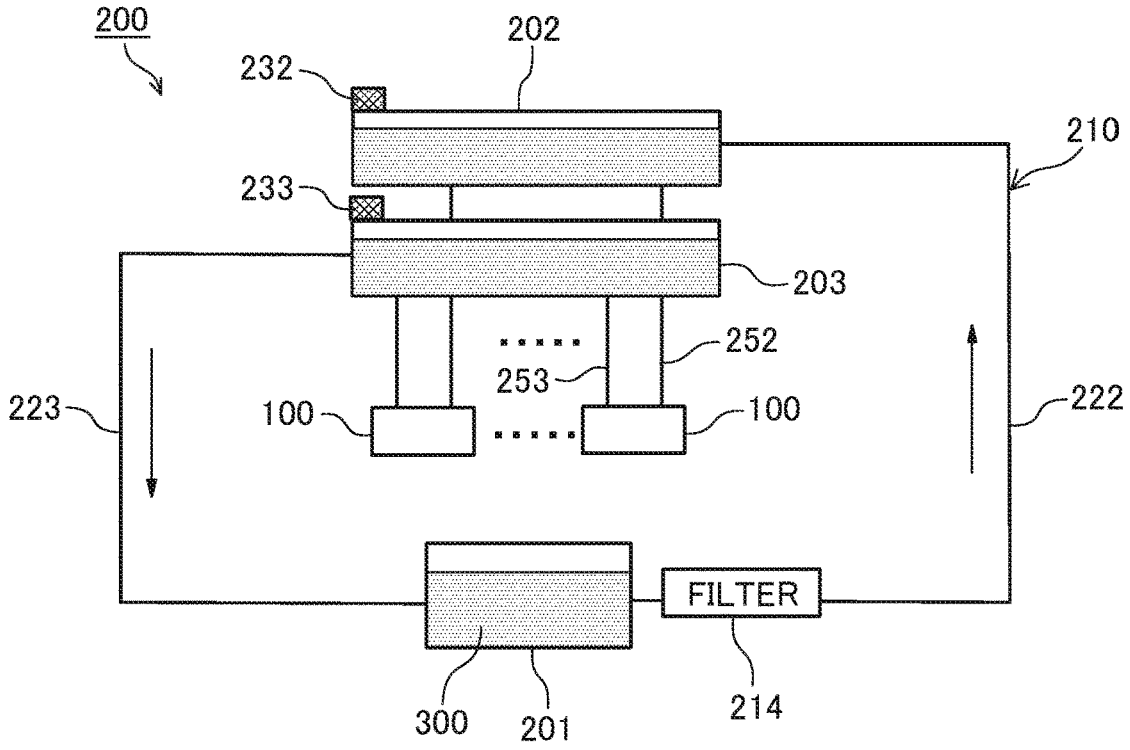
FIG. 12 is a diagram for explaining a liquid circulation device according to a second embodiment of the present disclosure.

Referring now to FIG. 12, a second embodiment of the present disclosure is described. FIG. 12 is a diagram for explaining a liquid circulation device according to the embodiment.

In this embodiment, a liquid feeding device is formed with a pressure adjuster 232 such as a pump or a valve capable of changing the amount of air in the supply tank 202, and a pressure adjuster 233 such as a pump or a valve capable of changing the amount of air in the collection tank 203.

The respective pressures in the supply tank 202 and the collection tank 203 are set at pressures lower than that in the main tank 201 by the pressure adjusters 232 and 233, so that the liquid can be drawn into the supply tank 202, and liquid feed can be performed.

Figure 13:
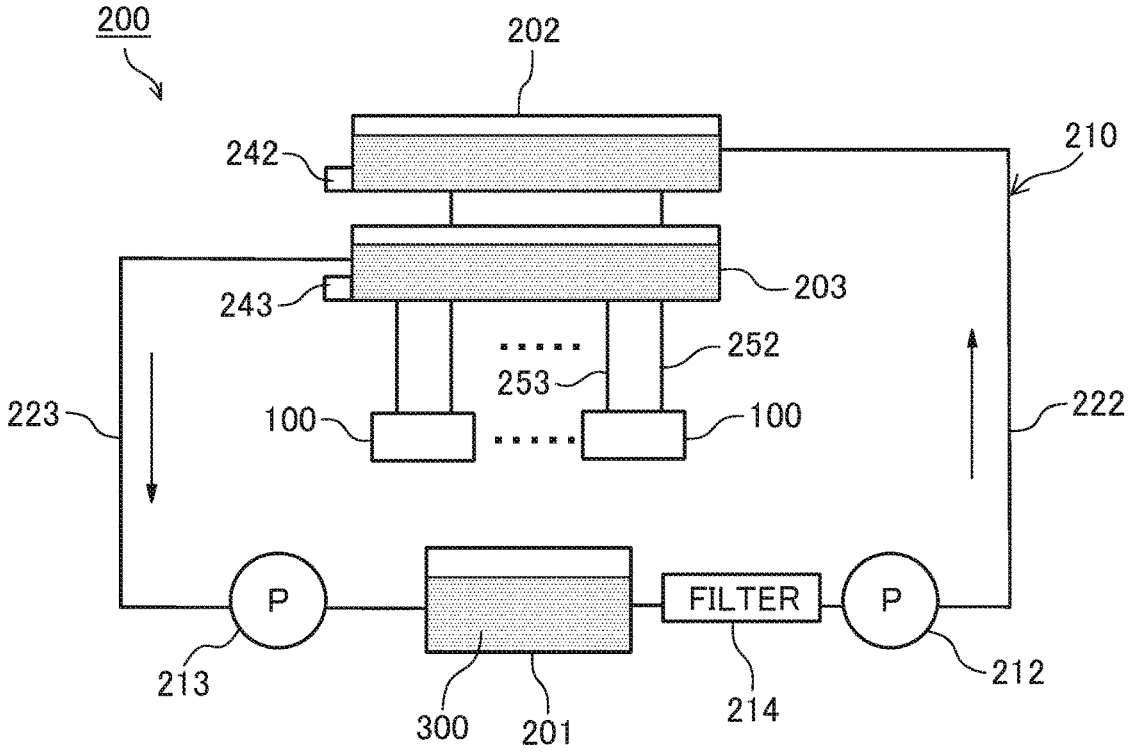
FIG. 13 is a diagram for explaining a liquid circulation device according to a third embodiment of the present disclosure.
Figure 14:
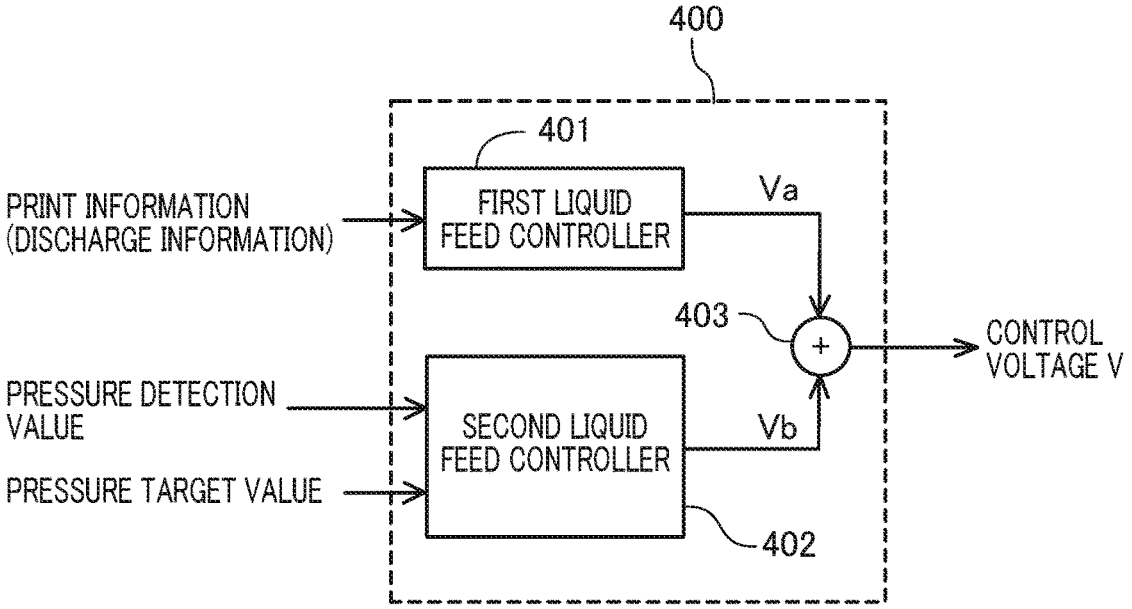
FIG. 14 is a block diagram for explaining the liquid feed controller.

Referring now to FIGS. 13 and 14, a third embodiment of the present disclosure is described. FIG. 13 is a diagram for explaining a liquid circulation device according to the embodiment. FIG. 14 is a block diagram for explaining a liquid feed controller according to the embodiment.

In this embodiment, a liquid circulation device includes a pressure sensor 242 that detects the pressure in the supply tank 202, and a pressure sensor 243 that detects the pressure in the collection tank 203.

The liquid feed controller 400 includes a first liquid feed controller 401, a second liquid feed controller 402, and an adder 403 that outputs control voltages V.

Like the liquid feed controller 400 of the first embodiment, the first liquid feed controller 401 is formed with a microcomputer such as a CPU, a ROM, a RAM, and an I/O, and acquires discharge information that is print information input to the printing apparatus 1000 by the user. The first liquid feed controller 401 then determines and outputs control voltages Va (the control voltage for the supply pump 212, and the control voltage for the collection pump 213), on the basis of the acquired discharge information.

The second liquid feed controller 402 is formed with a microcomputer such as a CPU, a ROM, a RAM, and an I/O, or is formed with an analog electronic circuit so that desired PID control can be performed. The second liquid feed controller 402 then determines and outputs control voltages Vb (the control voltage for the supply pump 212, and the control voltage for the collection pump 213), on the basis of the respective pressure detection values from the pressure sensor 242 and the pressure sensor 243, and the respective pressure target values of the supply tank 202 and the collection tank 203.

The adder 403 then adds the output (control voltages Va) of the first liquid feed controller 401 and the output (control voltages Vb) of the second liquid feed controller 402, to output control voltages V (control voltages V1 and V2).

That is, since the control voltages based on the discharge information are values obtained beforehand through an experiment or the like, an error might occur under the influence of variation, and there is a possibility that the pressures will not be maintained at desired values only by the first liquid feed controller 401. To counter this, the second liquid feed controller 402 is provided to prevent pressure fluctuation due to an error.

Figure 15:
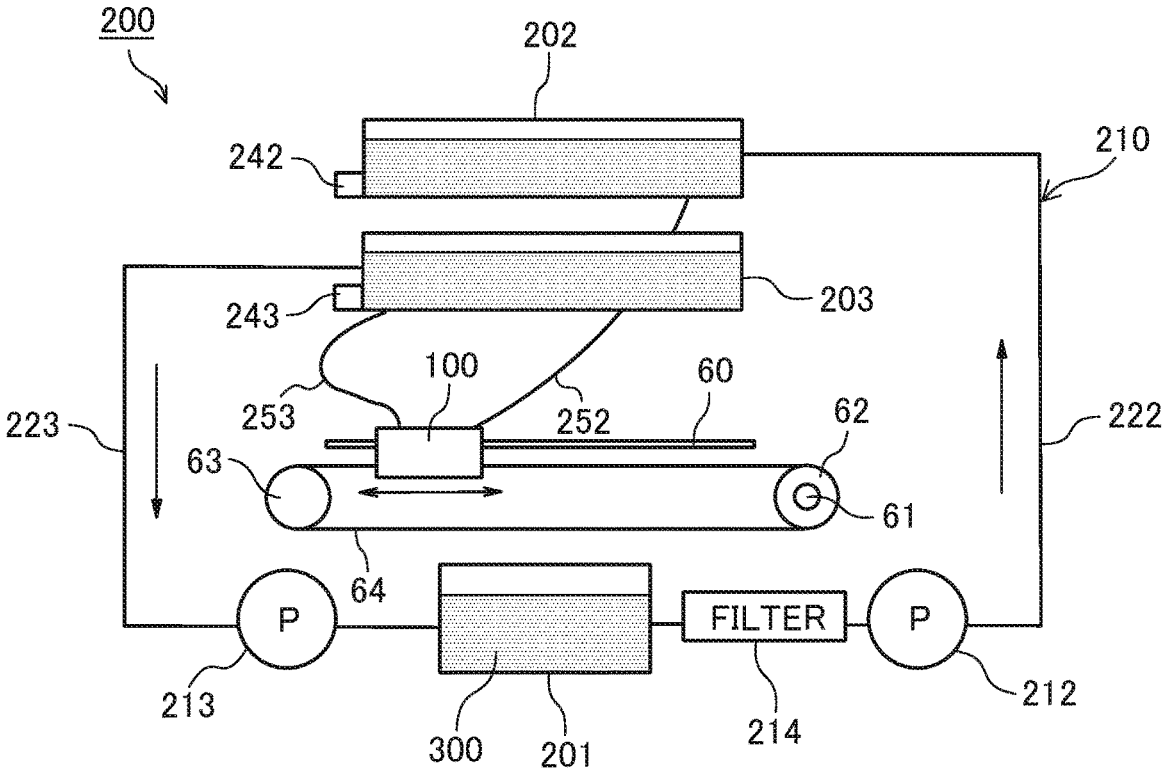
FIG. 15 is a diagram for explaining a liquid circulation device according to a fourth embodiment of the present disclosure.

Referring now to FIG. 15, a fourth embodiment of the present disclosure is described. FIG. 15 is a block diagram for explaining a liquid circulation device according to the embodiment.

In this embodiment, a head 100 is mounted on a carriage or the like, is movably held by a guide member 60, and is reciprocally moved by a pulling force generated by a timing belt 64 stretched between a driving pulley 62 that is rotationally driven by a drive source 61, and a driven pully 63.

The head 100 and the supply tank 202 are connected by a liquid path 252 formed with a flexible tube or the like, and the head 100 and the collection tank 203 are connected by a liquid path 253 formed with a flexible tube or the like.

In this manner, the respective embodiments described above can be applied to a serial-type liquid discharge apparatus in which the head 100 reciprocally moves.

Figure 16A:
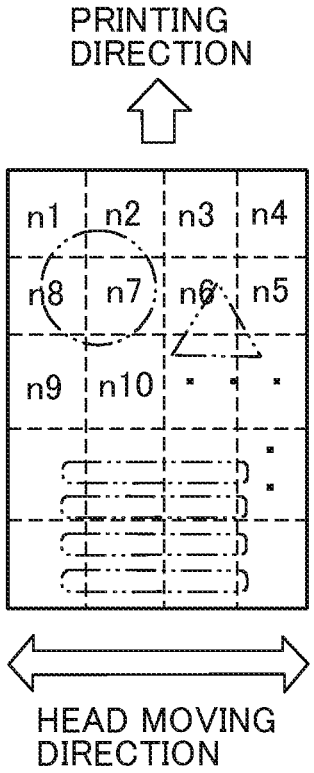
FIGS. 16A and 16B are diagrams for explaining a first example of region division of discharge information supplied to a liquid feed controller, and the settings of time series data in the fourth embodiment.
Figure 16B:
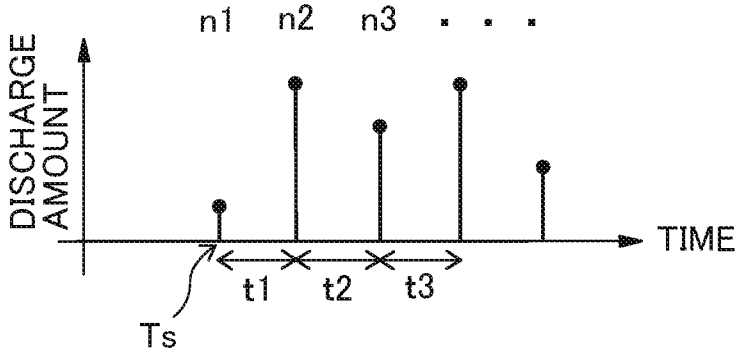

Referring now to FIGS. 16A and 16B, a first example of region division of discharge information supplied to a liquid feed controller, and the settings of time series data in the fourth embodiment of the present disclosure is described. FIGS. 16A and 16B are diagrams to be referred to in conjunction with the description.

When supplied with print information (image information) that is input by the user, the liquid feed controller according to the fourth embodiment divides the image information as the discharge information into a plurality of predetermined regions nx such as regions n1, n2, n3, . . . in the printing direction and the moving direction of the head 100 as illustrated in FIG. 16A, to convert the image information into discharge amount information for the respective regions nx.

On the basis of the calculated discharge amounts and the printing speed, discharge amounts are then set as time series data as illustrated in FIG. 16B.

The time tx (x=1, 2, 3, . . . ) of the time series data can be calculated as follows.

tx=length of region nx [m]/head movement speed [m/s] (x=1, 2, 3, . . . )

Figure 17A:
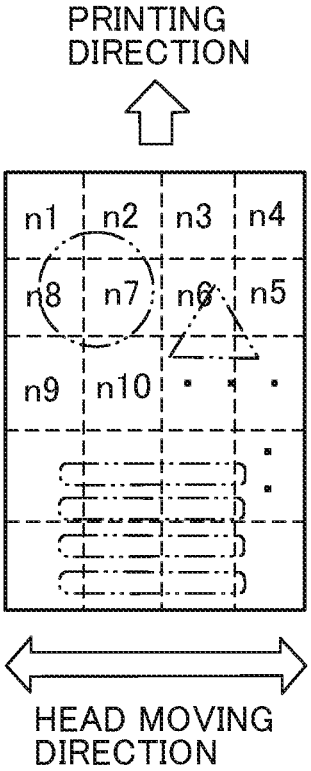
FIGS. 17A and 17B are diagrams for explaining a second example of the same.
Figure 17B:
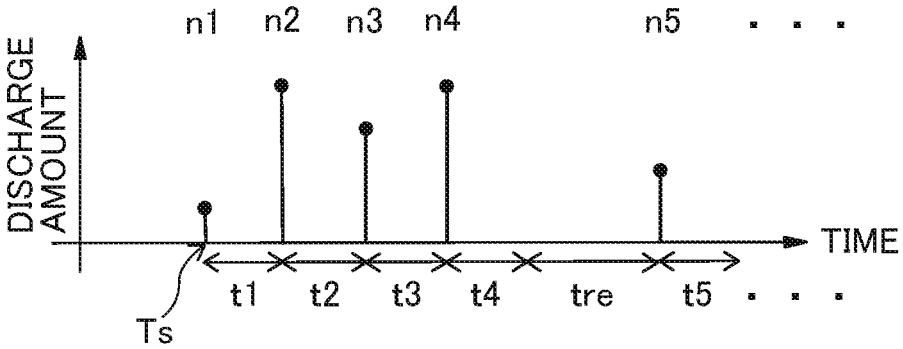

Referring now to FIGS. 17A and 17B, a second example of region division of discharge information supplied to the liquid feed controller, and the settings of time series data in the fourth embodiment of the present disclosure is described. FIGS. 17A and 17B are diagrams to be referred to in conjunction with the description.

Further, in a serial-type printing apparatus, there are cases where operation is switched between a bidirectional mode in which printing is performed in both the forward pass and the return pass of the head 100, and a unidirectional mode in which printing is performed only in one of the passes.

Therefore, in the unidirectional mode in which printing is performed only in one path, when time series data is set on the basis of discharge amounts calculated for the respective regions illustrated in FIG. 17A and the printing speed, time series setting is performed, with the time tre required for movement in the return path being taken into account, as illustrated in FIG. 17B.

Figure 18A:
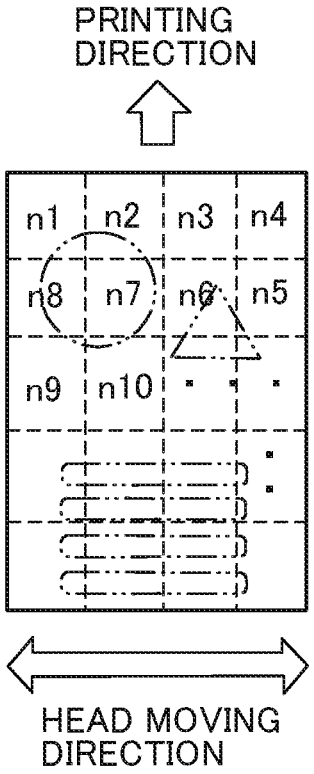
FIGS. 18A and 18B are diagrams for explaining an example of region division of discharge information supplied to a liquid feed controller, and the settings of time series data in a fifth embodiment of the present disclosure.
Figure 18B:
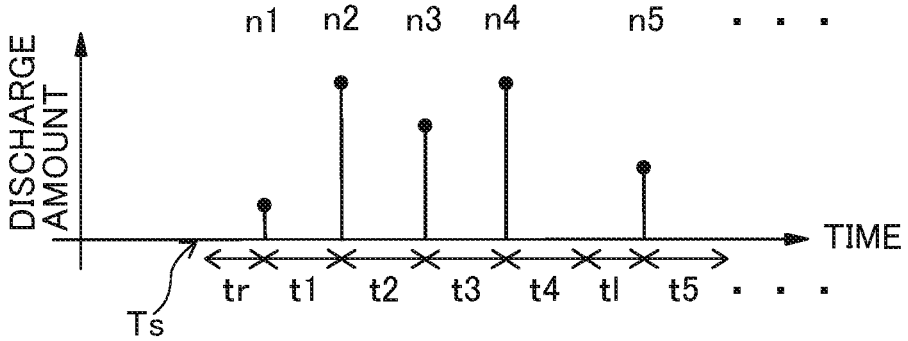

Referring now to FIGS. 18A and 18B, a fifth embodiment of the present disclosure is described. FIGS. 18A and 18B are diagrams for explaining an example of region division of discharge information supplied to a liquid feed controller and the setting of time series data in the embodiment.

In a serial-type printing apparatus, it might take more time to perform printing at the end of an image in the head movement direction than in the other regions. At the end of an image in the head moving direction, the head 100 is switched back.

Therefore, when time series data is set on the basis of discharge amounts calculated for the respective regions as illustrated in FIG. 18A and the printing speed, the time series data is set as the times tr and tl required for the respective end portions as illustrated in FIG. 18B.

In this application, the "liquid" to be discharged is not limited to any particular liquid, as long as the liquid has such a viscosity or surface tension that the liquid can be discharged from a head. However, the viscosity of the liquid is preferably not higher than 30 mPa·s under ordinary temperature and ordinary pressure, or by heating or cooling. More specifically, the liquid may be a solution, a suspension, or an emulsion containing a solvent such as water or an organic solvent, a colorant such as a dye or a pigment, a functionalizing material such as a polymerizable compound, a resin, or a surfactant, a biocompatible material such as DNA, amino acid, protein, or calcium, an edible material such as a natural pigment, or the like. Any of these liquids can be used as an inkjet ink, a surface treatment liquid, a liquid for forming components or an electronic circuit resist pattern for electronic elements or light-emitting elements, a three-dimensional fabricating material solution, or the like.

Examples of an energy source for generating energy to discharge liquid from a "liquid discharge head" include a piezoelectric actuator (a laminated piezoelectric element or a thin-film piezoelectric element), a thermal actuator that employs a thermoelectric conversion element such as a heating resistor, and an electrostatic actuator including a diaphragm and opposite electrodes.

A "liquid discharge apparatuses" may be an apparatus that drives a liquid discharge head to discharge liquid. A liquid discharge apparatus may be an apparatus capable of discharging liquid into air or liquid, instead of an apparatus capable of discharging liquid onto a medium to which liquid can adhere.

This "liquid discharge apparatus" may also include devices relating to feeding, conveyance, and sheet ejection of a medium to which liquid can adhere, a preprocessing device, and a post-processing device.

For example, a "liquid discharge apparatus" may be an image forming apparatus that forms an image on a paper sheet by discharging ink, or a stereoscopic fabricating apparatus (a three-dimensional fabricating apparatus) that discharges a fabricating liquid onto a powder layer formed from powder, to fabricate a solid object (a three-dimensional object).

A "liquid discharge apparatus" is not necessarily an apparatus that discharges liquid to visualize meaningful images, such as characters or figures. For example, a liquid discharge apparatus may form meaningless images, such as meaningless patterns, or fabricate three-dimensional images.

The "medium to which liquid can adhere" means a medium to which liquid can at least temporarily adhere, a medium to which liquid adheres and sticks, a medium to which liquid adheres and permeates, or the like. Specific examples of such media include media onto which recording is performed, such as paper sheets, recording paper, recording sheets, film, and cloth, electronic boards, electronic components such as piezoelectric elements, powder layers (powdery layers), organ models, and test cells. The specific examples include all media to which liquid can adhere, unless otherwise specified.

The material of the above "medium to which liquid can adhere" should be a medium to which liquid can at least temporarily adhere, such as paper, thread, fiber, cloth, leather, metal, plastic, glass, wood, or ceramics.

Alternatively, a "liquid discharge apparatus" may be an apparatus in which a liquid discharge head and a medium to which liquid can adhere move relative to each other, but is not necessarily such an apparatus. Specific examples of such apparatuses include a serial-type apparatus that moves the liquid discharge head, and a line-type apparatus that does not move the liquid discharge head.

Further, a "liquid discharge apparatus" may be a treatment liquid application apparatus that discharges a treatment liquid onto a paper sheet to apply the treatment liquid onto the surface of the paper sheet and modify the surface of the paper sheet, or an injecting granulation apparatus that granulates fine particles of a raw material by spraying a composition liquid containing the raw material dispersed in a solution through a nozzle, or the like.

Note that the terms "image formation", "recording", "printing", "image printing", and "fabricating" used herein are all synonymous.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A liquid circulation device comprising:

a circulation path configured to circulate a liquid to be supplied to a liquid discharge head of a circulatory type and collected from the liquid discharge head;

a supply tank configured to collect the liquid of the circulation path, and to supply the liquid to the liquid discharge head;

a collection tank configured to collect the liquid from the liquid discharge head, and to supply the liquid back to the circulation path;

a supply pump configured to pressurize the supply tank to drive the liquid from the supply tank to the liquid discharge head;

a collection pump configured to pressurize the collection tank to drive the liquid from the collection tank into the circulation path;

a first pressure sensor configured to detect a pressure of the supply tank;

a second pressure sensor configured to detect a pressure of the collection tank;

a first liquid feed controller configured to divide image data into a series of regions to be printed in respective periods of time, to acquire information of a discharge amount to be applied to each region, and to determine a first voltage for the supply pump and the collection pump based on the discharge amount for a region;

a second liquid feed controller configured to determine a second voltage for the supply pump and the collection pump based on target pressure values of the supply tank and the collection tank and pressure values detected by the first pressure sensor and the second pressure sensor; and an adder configured to apply a sum of the first voltage and the second voltage to the supply pump and the collection pump before the liquid discharge head performs a discharge operation on the region to reduce pressure fluctuation of the liquid discharge head.

2. The liquid circulation device according to claim 1, wherein the series of regions are divided in a direction of movement of a discharge target onto which the liquid is to be discharged from the liquid discharge head.

3. The liquid circulation device according to claim 1, wherein the series of regions are divided in a direction of movement of the liquid discharge head.

4. The liquid circulation device according to claim 1, further comprising a pressure sensor configured to detect pressure in the circulation path, wherein the circuitry controls the supply pump and the collection pump based on the pressure detected by the pressure sensor.

5. A liquid discharge apparatus comprising:

a plurality of liquid discharge heads; and the liquid circulation device according to claim 1.

6. The liquid discharge apparatus according to claim 5, wherein the plurality of liquid discharge heads is configured to discharge liquid to fabricate a solid object.

* * * * *